United States Patent [19]

Gross et al.

[11] Patent Number: 4,858,600

[45] Date of Patent: Aug. 22, 1989

[54] MASSAGING APPLIANCE

[75] Inventors: Joseph Gross, Moshav Mazor; David Lowenstein, Natanya; Menachem Tilman, Hofit; Etan Rosenberg, Kiryat Ono, all of Israel

[73] Assignee: General Ideas & Products Ltd., Tel Aviv, Israel

[21] Appl. No.: 113,305

[22] Filed: Oct. 28, 1987

Related U.S. Application Data

[63] Continuation-in-part of Ser. No. 76,346, Jul. 22, 1987, abandoned.

[51] Int. Cl.[4] ..... A61H 9/00

[52] U.S. Cl. ..... 128/65; 128/56

[58] Field of Search ..... 128/44–46, 128/56, 57, 67, 68 R, 24.3, 24.4, 49, 65

[56] References Cited

U.S. PATENT DOCUMENTS

| | | | |
|---|---|---|---|
| Re. 30,500 | 2/1981 | Springer et al. | 128/65 |
| 2,043,114 | 6/1936 | Ruttger-Pelli | 128/56 |
| 2,285,105 | 6/1942 | Laszlo | 128/56 |
| 3,081,769 | 3/1963 | Ackerman | 128/67 |
| 3,968,789 | 7/1976 | Simoncini | 128/49 |
| 4,203,431 | 5/1980 | Abura | 128/56 |

FOREIGN PATENT DOCUMENTS

| | | | |
|---|---|---|---|
| 0219996 | 5/1925 | United Kingdom | 128/49 |
| 0445929 | 4/1936 | United Kingdom | 128/57 |

*Primary Examiner*—David A. Wiecking
*Assistant Examiner*—Huong Q. Pham
*Attorney, Agent, or Firm*—Benjamin J. Barish

[57] ABSTRACT

A massaging appliance for massaging the face or other part of the body, comprises a housing enclosing an electrical motor, and a cream applicator having a chamber for containing a supply of cream to be applied during massaging. The applicator has a cylindrical side wall closed at one end by a first end wall to be placed in contact with the respective part of the body to be massaged, and closed at its opposite end by a second end wall coupled to the motor to be driven thereby. The first end wall is formed with a plurality of openings each occupied by a ball rotatably mounted therein for dispensing cream to the contacted part of the body, and the second end wall is formed with a central threaded opening. A piston is disposed within the applicator and includes a threaded stem receivable in the threaded opening of the second end wall enabling the piston to be adjusted, to contract or enlarge the chamber, by rotating the applicator side wall with respect to its second end wall.

17 Claims, 2 Drawing Sheets

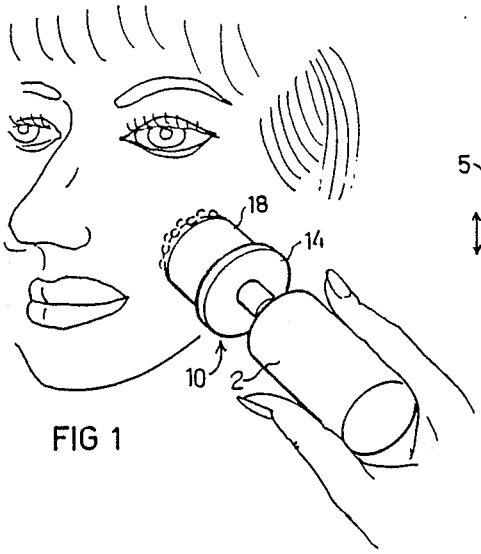
FIG 1
FIG 2
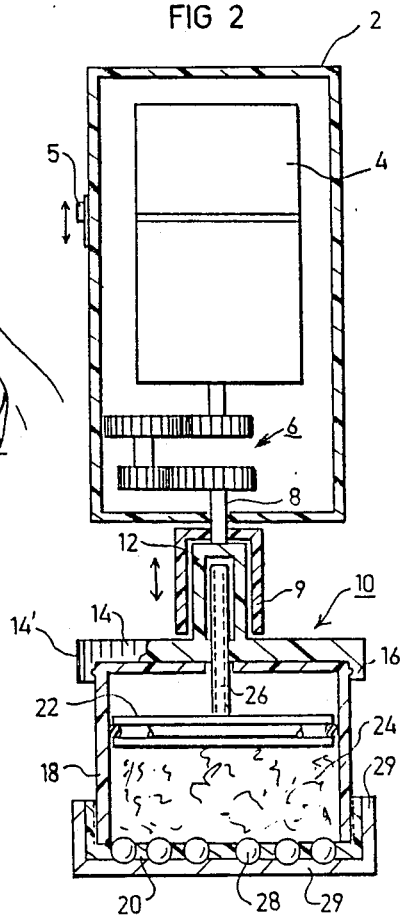
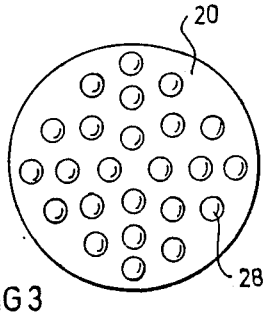
FIG 3
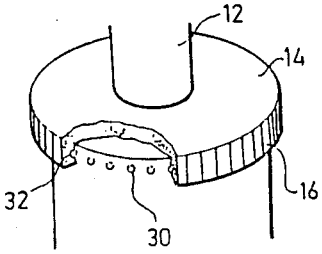
FIG 5
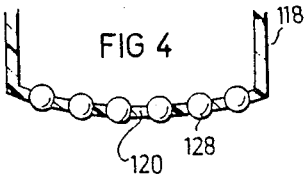
FIG 4

FIG 6
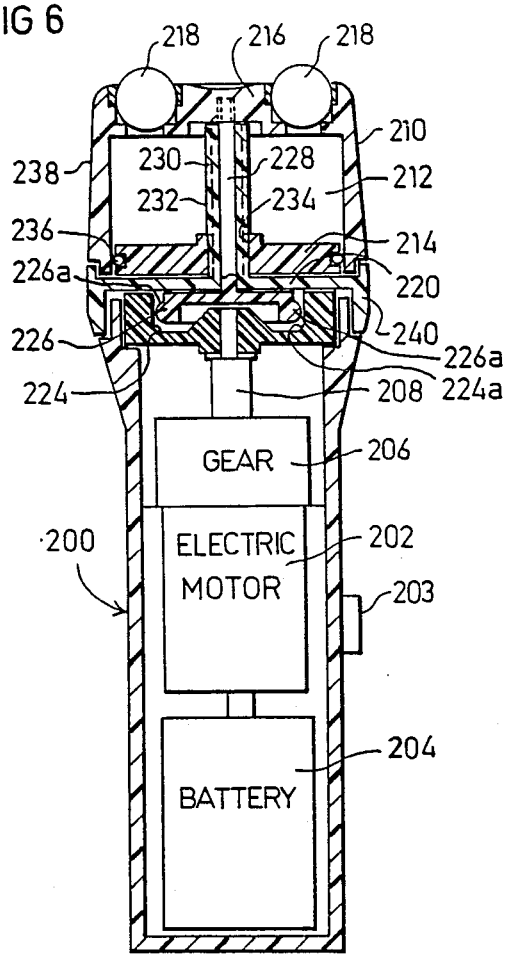
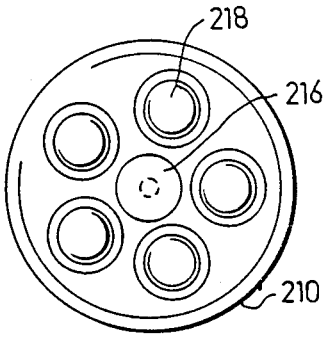
FIG 7

MASSAGING APPLIANCE

RELATED PATENT APPLICATION

The present application is a continuation-in-part of our pending application Ser. No. 07/076,346 filed July 22, 1987 now abandoned.

BACKGROUND OF THE INVENTION

The present invention relates to a massaging appliance, and particularly to one for massaging the face or other part of the body while applying a massaging substance thereto.

A number of massaging devices have been described in the prior art which devices include rotating balls for massaging the body part while applying the massaging substance to it. Examples of some of the known devices of this type are described in U.S. Pat. Nos. 1,947,042, 2,285,105, 4,037,977 and Re. 30,500.

An object of the present invention is to provide a massaging appliance of this type but having a number of advantages, as will be more particularly described below.

BRIEF SUMMARY OF THE INVENTION

According to the present invention, there is provided a massaging appliance for massaging a body part while applying a massaging substance thereto, comprising: a rotary drive; a rotatable housing containing a chamber for a supply of the massaging substance, and an outer end wall, defining the outer end of the chamber, and carrying a plurality of rotatably mounted balls for massaging the body part while applying massaging substance thereto; the rotatable housing including a displaceable member defining the inner end of the chamber and displaceable for contracting or expanding the size of the chamber according to the quantity of the massaging substance therein; and coupling means coupling the rotatable housing to the rotary drive.

According to preferred features of the invention as more particularly described below, the displaceable member is a piston movable axially towards and away from the outer end wall; also, the housing includes an inner end wall coupled to the rotary drive and having means cooperable with the piston for moving the piston axially with respect to the inner end wall upon effecting relative rotation between the piston and inner and wall.

Two embodiments of the invention are described below for purposes of example.

In one described embodiment, the piston is displaceable by the manual rotation of a part of the housing with respect to another part of the housing. In this embodiment, the piston is formed with an externally threaded stem received in a threaded opening in the inner end wall, and the rotatable housing further includes a cylindrical side wall. The inner end wall is manually rotatable with respect to the cylindrical side wall to manually move the piston axially within the chamber.

In a second described embodiment, the piston is displaceable by coupling the rotary drive to selectively rotate a part of the housing with respect to another part of the housing. More particularly, in this described embodiment, the piston is coupled to the drive by an externally threaded stem fixed to the inner end wall extending towards, and rotatable with respect to, the outer end wall; and the externally threaded stem is received within a threaded opening in the piston and is integrally formed with a ring disposed externally of the housing so as to be engageable by the user's finger to stop the rotation of the inner end wall, and thereby to move the piston axially as it rotates within the housing.

Also, in both described embodiments, the housing is quickly-attachable to, and detachable from, the rotary drive unit to permit the convenient replacement of a depleted housing with another housing filled with a supply of the massaging substance. Refilling, instead of replacement, may be effected by removing one of the end walls of the housing.

Further features and advantages of the invention will be apparent from the description below.

BRIEF DESCRIPTION OF THE DRAWINGS

The invention is herein described, by way of example only, with reference to the accompanying drawings, wherein:

FIG. 1 illustrates one form of massaging appliance constructed in accordance with the present invention and the manner of its use;

FIG. 2 illustrates the construction of the massaging appliance of FIG. 1;

FIG. 3 is an end view illustrating the cream-dispensing end of the applicator;

FIG. 4 is a fragmentary view illustrating a modification in the construction of the cream-dispensing end of the applicator;

FIG. 5 is a fragmentary view illustrating the ball-and-detent retainer means of the applicator for contracting its chamber according to the quantity of cream remaining therein.

FIG. 6 is a longitudinal sectional view illustrating a second form of massaging appliance constructed in accordance with the invention; and FIG. 7 is a top plan view illustrating he massaging appliance of FIG. 6.

DESCRIPTION OF PREFERRED EMBODIMENTS

Embodiment of FIGS. 1–5

The massaging appliance illustrated in the drawings comprises a housing, generally designated 2, enclosing an electrical motor rotary drive 4 and manually controlled by a switch button 5 on the outer face of the housing. Housing 2 also includes a step-down gearing 6 for driving the output drive shaft 8 at a reduced speed. The output drive shaft 8 carries a non-circular (e.g., square) socket coupling member 9 for coupling it to a housing, generally designated 10.

Housing 10 is formed with a complementary-shaped coupling member 12 receivable within socket 9 integrally formed on an inner end wall 14 of the housing. Socket member 9 carried by the output drive shaft 8, and coupling member 12 receivable within socket 9, thus constitute a coupling means coupling rotatable housing 10 to the rotary drive 4. End wall 14 is further formed with an annular flange 16 for receiving a cylindrical side wall 18 of the housing. The opposite end of the housing side wall 18 is closed by an outer end wall 20 threaded onto the respective end of the side wall.

Housing 10 further includes a displaceable member in the form of a piston 22 defining, with end wall 20, a chamber 24 for receiving a quantity of the massaging substance, e.g., cream, to be dispensed. Piston 22 defines the inner end of chamber 24 and is coupled to the rotary drive 4 by piston coupling means including an externally-threaded stem 26 threadedly received within an opening formed centrally of the inner end wall 14. End wall 20 is in turn formed with a plurality of openings each occupied by a ball 28 for dispensing the cream within chamber 24. A cap 29 is removably received over the outer end wall 20 and its dispensing balls 28 to prevent dispensing any cream when the appliance is not in use.

Piston 22 may be conveniently adjusted within the housing in order to enlarge or contract chamber 24 according to the quantity of cream within the chamber. For this purpose, cylindrical side wall 18 of housing 10, together with its cream-dispensing end wall 20, is rotatable with respect to end wall 14.

Housing 10 further includes cooperable ball-and-detent retainer means, in the form of a circular array of semi-spherical detents 30 formed on the outer face of side wall 18 cooperable with a semi-spherical ball 32 formed on the inner face of annular flange 16 of end wall 14. End wall 14 is integrally formed with a knurled external ring 14' (FIG. 2) which may be gripped with one hand, while the cylindrical side wall 18 is gripped and rotated with the other. Because of the tight fit of piston 22 via its O-ring with respect to the housing side wall 18, the rotation of side wall 18 will rotate the piston and its threaded stem 26 in the threaded opening formed in end wall 14 to thereby move the piston axially to contract or expand chamber 24 according to the direction of rotation. Thus, as the quantity of cream within chamber 24 decreases, the size of the chamber can be reduced by rotating side wall 18 with respect to its end wall 14.

Balls 28 which dispense the cream are preferably of a plastic material, such as nylon, or of an elastomeric material, such as natural or synthetic rubber.

As shown in FIG. 2, end wall 20 containing the dispensing balls 28 is of substantially planar configuration. FIG. 4 illustrates a modification wherein this end wall 120, formed in the housing side wall 118 and containing the dispensing balls 128, is of a convex configuration.

The manner of using the illustrated appliance will be apparent from the above description. The user, after removing the protective cap 29 and operating the start push-button 5, gently applies end wall 20 of housing 10 against the user's face as the housing is rotated by the electric motor 4. The user may also manually apply circular movements to the housing while pressed against the face. This produces a good massaging action as cream is dispensed to the face from chamber 24 via balls 28 in contact with the face.

As the quantity of cream becomes depleted from chamber 24, piston 22 within the housing may be moved to contract chamber 24 by rotating side wall 18 with respect to the inner end wall 14. This rotates the threaded piston stem 26 in the threaded opening in end wall 14, and thereby moves the piston axially in chamber 24, as described above. During this rotation of the housing side wall, a "clicking" action is produced between the retainer detents 30 on the upper end of the housing side wall 18, and the ball 32 in annular flange 16 of end wall 14. In addition, the ball-and-detent retainer means also releasably retains the housing side wall 18, outer end wall 20, and piston 22 in any adjusted position.

When the quantity of massaging substance within chamber 24 has been depeleted, the outer end wall 20 may be removed and the chamber refilled with another quantity. Alternatively, the housing 10 can be constructed for one-time use to be replaced by a refill housing unit whenever the supply of massaging substance is depleted.

Embodiment of FIGS. 6 and 7

The massaging appliance illustrated in FIGS. 6 and 7 includes a housing 200 for an electrical motor rotary drive comprising a motor 202, battery 204 and step-down gearing 206 for driving the output drive shaft 208 at a reduced speed. Motor 202 is controlled by an electrical switch 203 on the outer face of housing 200. Motor 202 is of the reversible type, and electrical switch 203 is therefore provided with three positions, namely, "Off", "Forward" and "Reverse".

The illustrated appliance further includes a second housing 210 rotatably mounted to the drive housing 200 and coupled to the drive shaft 208 so as to be rotated thereby. Housing 210 includes a chamber 212 for the massaging substance, e.g., cream. Chamber 212 is defined at one side by a displaceable piston 214, and at the other side by an outer end wall 216 carrying a plurality of rotatably-mounted balls 218 for massaging the body part while applying thereto the massaging substance within chamber 212. The rotatable housing 210 further includes an inner end wall 220 adjacent to the drive unit housing 200.

The mechanical coupling between the drive output shaft 208 and housing 210 includes a first coupling plate 224 secured to the drive shaft 208, and a second coupling plate 226 secured to the rotatable housing 210. Plate 226 is integrally formed with a shaft 228 extending through chamber 212 and threaded into the outer end wall 216 of the housing. Shaft 228 is enclosed by a hollow stem 230 freely received over the shaft and formed with external threads 232 receivable within a threaded opening 234 formed in piston 214. Piston 214 carries an O-ring 236 forming a tight fit with the inner face of the cylindrical side wall of housing 210.

The two coupling plates 224 and 226 are coupled to each other by a quickly-attachable friction coupling. For this purpose, the inner face of the driving coupling member 224 is formed with a socket including an inwardly-extending annular recess **224*a* around its circumference, and the driven coupling member 226 is formed with a plug including a complementary annular rib 226*a* around its circumference insertable by hand pressure into the socket of coupling member 224** to provide a friction coupling between the two members.

The inner end wall 220 normally rotates with the cylindrical side wall of housing 210 and the outer end wall 216. However, inner end wall. 220 is rotatably mounted with respect to both of the housings 200 and 210, and includes an external ring 240 which may be pressed by the user's finger in order to stop or retard the rotation of end wall 220 whenever it is desired to move piston 214 to contract or to enlarge chamber 212, as will be described more particularly below.

The illustrated implement operates as follows:

It will be assumed that piston 214 is in the position illustrated in FIG. 6, thereby defining a chamber 212 of maximum volume, with the chamber filled with the massaging substance, e.g., a cream. Switch 203 is operated to its "Forward" position, thereby driving electric motor 202 in the forward direction. The motor rotation is stepped-down by gearing 206 to cause the drive shaft 208 to rotate at a relatively slow speed. Coupling plate 224, directly coupled to the drive shaft 208, is rotated at the same speed and rotates housing 210 via the transmission including coupling plate 226, shaft 228, and the outer end wall 216 of housing 210. The tight fit, via O-ring 236, between piston 214 and the inner face of housing 210 also causes the piston to rotate with the housing; and the threaded coupling between the piston and stem 230 causes the stem, together with its inner end wall 220 and its outer ring 240, also to rotate with housing 210.

During this rotation of housing 210, the outer end wall 216, and the balls 218 carried thereby are gently pressed against, and manipulated (preferably by a circular motion) along, the outer face of the body part (e.g., the user's face) to be massaged. During this massaging action, balls 218 dispense massaging substance from chamber 212.

As some of the massaging substance from chamber 212 is dispensed in the above manner, balls 218 will tend to pick up less and less of such substance. In order to increase the quantity of the substance picked up by balls 218, chamber 212 is contracted by the user pressing his (or her) finger against the outer ring 240 which stops or retards its rotation with housing 210. This causes the rotation of stem 230 also to be momentarily stopped or retarded. Therefore piston 214, threadedly received on stem 232, is moved axially within chamber 212 towards the outer end wall 216, since piston 214 continues to rotate with housing 210 because of the tight fit (O-ring 236) between the piston and the inner face of the housing. When chamber 212 has been contracted sufficiently so as to restart or increase the quantity of the massaging substance dispensed by the balls 218, the user releases the external ring 240, whereby the ring will again rotate with housing 210 so as to terminate further movement of piston 214 within chamber 212.

When piston 214 has travelled the full length of chamber 212, engaging the inner face of the outer end wall 216, its further rotation will be blocked by end wall 216 when the user presses a finger against the outer ring 240 to move piston 214 in order to dispense further massaging substance. Therefore a large load will be imposed on shaft 228 and its electric motor 202. This will overload the motor, causing it to stall and/or to make a large noise, thereby signalling to the user that the supply of the massaging substance within chamber 212 has been depleted.

In order to refill chamber 212 with a new supply of massaging substance, electric switch 203 is operated to its "Reverse" position, thereby reversing the direction of rotation of motor 202, housing 210, stem 230 and piston 214; and at the same time the user presses against the external ring 240 to block the rotation of stem 232. Thus, piston 214 is now rotated in the reverse direction on the stationary stem 230, thereby moving the piston towards the inner end wall 220 to enlarge chamber 212. When piston 214 has been moved to the position illustrated in FIG. 6, against the inner end wall 220, chamber 212 is of maximum volume. Housing 210 may then be detached from housing 200 by pulling out housing 210 causing the annular rib **226*a* of coupling plate 226 to separate from the annular recess 224*a* of coupling plate 224**.

Housing 210 is then rotated with respect to ring 210, thereby unthreading shaft 228 from the outer end wall 216. This opens the outer end of housing 210, permitting it to be refilled with a new supply of massaging substance.

It will be appreciated that, as in FIGS. 1–5, housing 210 can also be supplied as one-time use refill units.

The cylindrical side wall of housing 210 may be of transparent material in order to enable the user to see the quantity of the massaging substance within the chamber 212.

While the invention has been described with respect to two preferred embodiments, it will be appreciated that many other variations, modifications and application of the invention may be made.

What is claimed is:

1. A massaging appliance for massaging a body part while applying a massaging substance thereto, comprising:

a rotary drive including a rotary drive shaft;

a rotatable housing containing a chamber for a supply of the massaging substance, and an outer end wall, derining the outer end of said chamber and carrying a plurality of rotatably mounted balls for massaging the body part while applying massaging substance thereto;

said rotatable housing including a displaceable member defining one end, constituting the inner end of said chamber, said displaceable member being disposed parallel to, and being displaceable towards and away from, said outer end wall for contracting or expanding the size of the chamber according to the quantity of the massaging substance therein;

said rotary drive being external to said rotatable housing;

and coupling means coupling said rotatable housing to said rotary drive shaft.

2. The appliance according to claim 1, wherein said displaceable member is a piston movable axially towards and away from said outer end wall.

3. The appliance according to claim 2, wherein said housing includes an inner end wall coupled by said coupling means to said rotary drive shaft and having means cooperable with said piston for moving the piston axially with respect to said inner end wall upon effecting relative rotation between the piston and inner end wall.

4. The appliance according to claim 3, wherein said piston is formed with a threaded stem cooperable with a threaded opening formed in the inner end wall, such that said piston is axially moved with respect to said inner end wall upon effecting relative rotation between the piston and inner end wall.

5. The appliance according to claim 4, wherein said coupling means comprises a coupling member fixed to said inner end wall around said threaded opening so as to enclose said threaded stem, and a socket fixed to said drive shaft and receiving said coupling member in a quickly attachable-detachable manner.

6. The appliance according to claim 5, wherein said socket and sleeve are of complementary non-circular configuration.

7. The appliance according to claim 4, wherein said rotatable housing further includes a cylindrical side wall, said inner end wall being manually rotatable with respect to said cylindrical side wall to manually move the piston axially within said chamber.

8. The appliance according to claim 7, wherein said inner end wall includes a knurled outer ring to facilitate its manual rotation with respect to said cylindrical side wall.

9. The appliance according to claim 7, wherein said inner end wall and the cylindrical side wall include cooperable ball-and-detent means for producing a "clicking" sound during the rotation of the cylindrical side wall with respect to said inner end wall, and for releasably retaining the cylindrical side wall in its rotated position with respect to said inner end wall.

10. The appliance according to claim 2, further including piston coupling means coupling the piston to said rotary drive shaft to move the piston axially within said chamber.

11. The appliance according to claim 10, wherein said piston coupling means comprises an externally threaded stem fixed to said inner end wall extending towards, and rotatable with respect to, said outer end wall; said externally threaded stem being received within a threaded opening in said piston and integrally formed with an external ring disposed externally of said housing so as to be engageable by the user's finger to stop the rotation of the inner end wall, and thereby to move the piston axially as it rotates within said housing.

12. The appliance according to claim 11, wherein said coupling between the rotary drive and the rotary housing comprises a coupling member coupled at one end to said rotary drive and at the opposite end to said inner end wall.

13. The appliance according to claim 12, wherein said coupling member is quickly-attachable to another coupling member fixed to the rotary drive shaft of the rotary drive.

14. The appliance according to claim 13, wherein the piston and inner end wall are removable from the housing for refilling said chamber with the massaging substance.

15. The appliance according to claim 1, wherein said outer end wall is threadedly attached to the housing to permit its removal for refilling said chamber with the massaging substance.

16. The appliance according to claim 1, wherein said displaceable member is displaceable by the manual rotation of a part of the housing with respect to another part of the housing.

17. The appliance according to claim 1, wherein said coupling means couples said electric motor drive shaft to said housing in a quickly-attachable manner to permit the convenient replacement of the housing with another housing filled with a supply of the massaging substance.

* * * * *